United States Patent [19]

Kyono et al.

[11] Patent Number: 5,049,419

[45] Date of Patent: Sep. 17, 1991

[54] METHOD FOR MANUFACTURING A PRECURSOR WIRE FOR A CARBON-FIBER-REINFORCED METAL COMPOSITE MATERIAL

[75] Inventors: Tetsuyuki Kyono; Tohru Hanano; Tohru Hotta, all of Otsu, Japan

[73] Assignee: Toray Industries, Inc., Tokyo, Japan

[21] Appl. No.: 524,079

[22] Filed: May 16, 1990

[30] Foreign Application Priority Data

May 18, 1989 [JP] Japan ..... 1-125788

[51] Int. Cl.[5] ..... C23C 16/30; C23C 16/38; C23C 16/02; C23C 2/12

[52] U.S. Cl. ..... 427/251; 427/250; 427/252; 427/253; 427/255.1; 427/255.2; 427/314; 427/431; 427/432; 427/434.2; 427/434.6

[58] Field of Search ..... 427/314, 250, 251, 252, 427/253, 255.1, 255.2, 431, 432, 434.2, 434.6

[56] References Cited

U.S. PATENT DOCUMENTS

| | | | |
|---|---|---|---|
| 3,860,443 | 1/1975 | Lachman et al. | 117/106 |
| 3,894,863 | 7/1975 | Lachman et al. | 75/138 |
| 4,082,864 | 4/1978 | Kendall et al. | 427/253 |
| 4,097,624 | 6/1978 | Schladitz | 427/251 |
| 4,145,471 | 3/1979 | Kendall et al. | 428/366 |
| 4,223,075 | 9/1980 | Harrigan, Jr. et al. | 428/610 |

FOREIGN PATENT DOCUMENTS

| | | |
|---|---|---|
| 57-49675 | 10/1982 | Japan . |
| 59-12733 | 3/1984 | Japan . |

OTHER PUBLICATIONS

"Failure Modes in Composites", IV, p. 301 in a publication of the Metallurgical Society of AIME, 1979.

*Primary Examiner*—Shrive Beck
*Assistant Examiner*—Margaret Burke
*Attorney, Agent, or Firm*—Birch, Stewart, Kolasch & Birch

[57] ABSTRACT

A method for manufacturing a precursor wire for a CFRM material, which comprised a continuous carbon fiber bundle of carbon filaments as a reinforcement and a metal as a matrix. In a pretreatment process, the fiber bundle with a sizing agent adhered thereto is passed through an inert atmosphere at a temperature in the range of from 350° to 800° C., thereby thermally decomposing the sizing agent, the chemical structure of the sizing agent including ether linkages, and a residue of thermal decomposition containing the ether linkages is left on the surface of each single filament. In a chemical vapor deposition process, a material gas containing a titanium compound and a boron compound and a reducing gas containing zinc are caused to act simultaneously on the fiber bundle at a temperature in the range of from 700° to 800° C. after the sizing agent is thermally decomposed, thereby forming a primary layer of oxides of titanium and boron on each of the single filaments, and a surface layer of titanium and boron is formed on the primary layer. The primary layer and the surface layer serve considerably to improve the wettability between the carbon fibers and the matrix metal.

9 Claims, 3 Drawing Sheets

METHOD FOR MANUFACTURING A PRECURSOR WIRE FOR A CARBON-FIBER-REINFORCED METAL COMPOSITE MATERIAL

BACKGROUND OF THE INVENTION

1. Field of the Invention

The present invention relates to a method for manufacturing a precursor wire used for the manufacture of a carbon-fiber-reinforced metal composite material.

2. Description of the Related Art

A carbon-fiber-reinforced metal composite materials (CFRM) composing of carbon fibers as a reinforcement and a metal as a matrix, especially such as aluminum, magnesium, or an alloy thereof for the matrix, has excellent heat resistance and thermal conductivity, and are particularly high in specific strength and specific modulus. Therefore, these materials are considered to be promising for using in various fields of application, particularly for aerospace application.

The CFRM may be manufactured by several methods. In one of these methods, continuous fiber bundles of carbon filaments are introduced into a molten metal to be impregnated with the molten metal, and are drawn up, whereupon the molten metal is solidified to provide precursor wires. These precursor wires are arranged in order in one direction, for example, and are joined together, for example, into a plate and a tube by means of a hot press or the like.

Intrinsically, however, the carbon fibers are not easy to be wet with a molten metal, so that it is very difficult to manufacture high-performance precursor wires or CFRM. Accordingly, methods for improving the wettability between carbon fibers and a molten metal have been studied for long time.

A method for improving the wettability is described in U.S. Pat. Nos. 3,860,443 and 3,894,863 and their supposed Japanese version, Examined Japanese Patent Publication No. 59-12733. According to this method, a layer of titanium boride or of a mixture of titanium boride and titanium carbide is formed on the surface of each carbon filament by chemical vapor deposition (CVD process) in which a mixture of gaseous compounds of titanium and boron is reduced on the filament surface. In U.S. Pat. Nos. 4,082,864 and 4,145,471, moreover, is mentioned that if a layer of metallic boride in thickness of submicron orders is formed on the carbon filaments by the CVD process, the boride layer serves to restrain the reaction between the filaments and a metal matrix, thereby ensuring strong mechanical adhesion between them. In U.S. Pat. No. 4,223,075, furthermore, is mentioned that a titanium-boron coating on carbon fibers can be effectively restrained from diffusing into a molten matrix metal, when the carbon fibers are dipped into the molten metal, by previously adding titanium and boron, as alloy elements, to the matrix metal. Further, "Failure Modes in Composites" IV, page 301 in A publication of The Metallurgical Society of AIME, 1979, has a description that a sizing agent adhering to carbon fibers must be removed before the CVD process, in the aforesaid method. As is generally known, the sizing agent is used to bind a continuous fiber bundle consisting single carbon filaments, thereby improving the handling properties of the fiber bundle. Conventionally, epoxy resin is used as the sizing agent.

If the aforementioned conventional method is executed under given conditions, however, the wettability cannot always be satisfactorily improved, and the state of impregnation into the continuous fiber bundle with the molten metal varies depending on the direction, widthwise or lengthwise, of the bundle. Thus, it is very difficult to manufacture precursor wires with good uniformity even if much effort is made.

OBJECT AND SUMMARY OF THE INVENTION

The object of the present invention is to provide a method for manufacturing a precursor wire, improved in uniformity due to higher wettability between carbon fibers and a molten metal.

According to the present invention, there is provided a method for manufacturing a precursor wire for a carbon-fiber-reinforced metal composite material, which comprises: a pretreatment process for passing a continuous fiber bundle including a number of single carbon filaments with a sizing agent adhered thereto through an inert atmosphere at a temperature in the range of from 350° to 800° C., thereby thermally decomposing the sizing agent, the chemical structure of the sizing agent including ether linkages, and leaving a residue of thermal decomposition containing the ether linkages on the surface of each of the single filaments; a chemical vapor deposition process for causing a material gas containing a titanium compound and a boron compound and a reducing gas containing zinc to act simultaneously on the continuous fiber bundle at a temperature in the range of from 700° to 800° C. after the sizing agent is thermally decomposed, thereby forming a primary layer consisting of titanium oxides and boron oxides on each of the single filaments, and forming a surface layer consisting of titanium and boron on the primary layer; and a composite process for introducing the continuous fiber bundle, with the primary layer and the surface layer formed thereon, into a molten metal used to form a matrix, while isolating the continuous fiber bundle from the open air, thereby impregnating the continuous fiber bundle with the molten metal, and drawing up the fiber bundle so that the molten metal is solidified.

Preferably, the metal used to form the matrix is selected from the group of metals consisting of aluminum, aluminum alloy, magnesium, magnesium alloy, tin, tin alloy, zinc, and zinc alloy.

If the metal used to form the matrix is aluminum or aluminum alloy, the band width of the carbon fibers, with respect to $\frac{2}{3}$ of the peak height of the Raman band in the vicinity of 1,585 $cm^{-1}$ wave number, attributable to $E_{2g}$ symmetrical vibration of the graphite structure, in a spectrum obtained by the laser Raman spectroscopic analysis, preferably ranges from 25 to 75 $cm^{-1}$.

Preferably, moreover, the metal used to form the matrix is aluminum alloy containing 0.45% or less of silicon and 0.1% or less of copper, by weight.

Preferably, furthermore, the quantity of the ether linkages left on the surface of the carbon fibers by the thermal decomposition of the sizing agent is detected by the electron spectroscopy for chemical analysis so that its atmic ratio of oxygen to carbon ranges from 0.1 to 0.5.

The above and other objects, features, and advantages of the invention will be more apparent from the ensuing detailed description taken in connection with the accompanying drawings.

DETAILED DESCRIPTION

Figure 1:
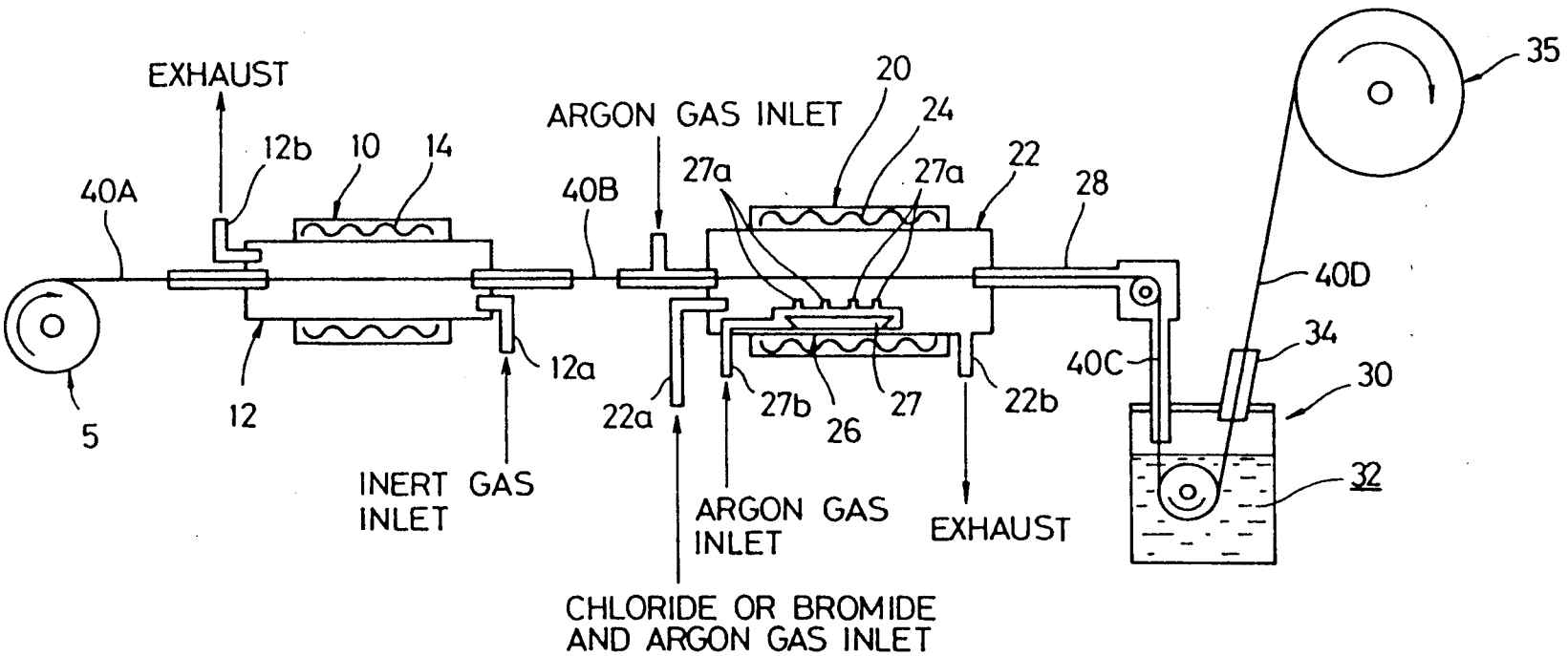
FIG. 1 is a diagram showing a layout of a precursor wire manufacturing apparatus for effecting a method according to the present invention.

Individual processes of a manufacturing method according to the present invention will now be described in detail.

Pretreatment Process

In this process, a continuous fiber bundle of carbon filaments (hereinafter referred to as carbon fiber bundle) is passed through an inert or inactive atmosphere at the temperature in the range of from 350° to 800° C., so that a sizing agent, which is adhered to the carbon fiber bundle and whose chemical structure includes ether linkages, is thermally decomposed, and a residue of thermal decomposition containing the ether linkages is left on the surface of each single filament.

The carbon fibers, which may be of a material based on polyacrylonitrile, pitch, rayon, or the like, should be tied up in a continuous fiber bundle. Usually, the carbon fibers are in the form of strands. Alternatively, however, they may be formed of woven or knitted stuff.

Further, the carbon fibers may or may not be ones which are subjected to surface oxidation treatment.

If the metal material which is used as a matrix mentioned later is aluminum or an alloy thereof, the band width (hereinafter referred to as $I_A$-$\frac{2}{3}$ width) of the carbon fibers used, with respect to $\frac{2}{3}$ of the crystalline band strength (peak height) in a spectrum obtained by the laser Raman spectroscopic analysis, should range from 25 to 75 $cm^{-1}$, preferably from 30 to 60 $cm^{-1}$. The carbon fibers of this type are highly graphitized and are so much inactive, so that they are reluctant to a reaction on aluminum. Thus, a precursor wire with improved strength can be manufactured.

As is generally known, the Raman spectroscopy is a method for obtaining information on the molecular structure of a substance by utilizing the Raman effect. The Raman effect is a phenomenon such that a scattered light beam with a wavelength shifted by a margin peculiar to a substance is observed when a laser beam is applied to the substance. According to the present invention, the spectroscopic analysis is performed in the following manner, by using a laser Raman system "Ramanor" U-1000, producted by Jobin Yvon & Co., Ltd., France. An argon-ion laser of 514.5-nm wavelength is applied to a carbon fiber bundle attached to a holder, in a nitrogen atmosphere, and a Raman-scattered light beam is condensed. Thereafter, the condensed beam is separated into its spectral components by double grating, and their intensity is detected by means of a photomultimeter. The resulting spectra are measured by the photon counting system and recorded on a chart. The analysis is made on the basis of the $\frac{2}{3}$-width determined from the chart.

As mentioned before, the carbon fibers are coated with the sizing agent whose chemical structure includes ether linkages. The ether linkage is a linkage expressed by one of general formulas R-O-R', Ar-O-R, or Ar-O-Ar' (R, R'=alkyl group; Ar, Ar'=aryl group). Sizing agents containing ether linkages include epoxy resins of the glycidyl-ether type, polyethers, polyesters, etc.

For example, the epoxy resin sizing agents include the following materials.

(1) Bisphenol type resins: Resins obtained by the condensation of epichlorohydrin and bisphenols, such as bisphenol A, bisphenol F, 2,2'-bis(4-hydroxyphenyl)-butane, etc., for example.

(2) Phenol type resins: Resins obtained by causing epichlorohydrin to act on novolac phenol resins, for example.

(3) Ester type resins: Copolymers of glycidyl methacrylate and monomers containing ethylenic linkage (e.g., acrylonitrile, styrene, vinyl acetate, vinyl chloride, etc.), for example.

(4) Ether type resins: Resins obtained by causing epichlorohydrin to act on conventional polyols or polyether polyols, for example.

The polyether type sizing agents include the following materials.

(1) Hydroxyl-terminated polyethers obtained by the addition polymerization of polyhydric alcohols, such as ethylene glycol, propylene glycol, butylene glycol, glycerin, trimethylolpropane, pentaerythritol, etc., and one or more alkylene oxides, such as ethylene oxide, propylene oxide, butylene oxide, tetrahydrofuran, etc.

(2) Alkylene oxide polymers polymerized by addition of polyhydric phenols, such as resorcinol, bisphenol, etc.

(3) Alkylene oxide polymers polymerized by addition of polybasic carboxylic acids, such as succinic acid, adipic acid, fumaric acid, maleic acid, glutaric acid, dimer acid, pyromellitic acid, etc.

The polyester type sizing agents include the following materials.

(1) Condensates of polyhydric alcohols, such as ethylene glycol, butylene glycol, glycerin, trimethylolpropane, pentaerythritol, etc., and polybasic carboxylic acids, such as succinic acid, adipic acid, fumaric acid, maleic acid, glutaric acid, dimer acid, pyromellitic acid, etc.

(2) Condensates of hydroxy-carboxylic acid and polyhydric alcohols, such as ethylene glycol, butylene glycol, glycerin, trimethylolpropane, pentaerythritol, etc. Besides, reaction products from castor oil or castor-oil fatty acid and ethylene glycol, propylene glycol, etc. are available.

The sizing agent is adhered to the carbon fibers by a well-known method, as is described in Published Examined Japanese Patent Publication No. 57-49675. In short, according to the present invention, carbon fibers coated with a sizing agent, whose chemical structure includes ether linkages, may be selected and used.

In the pretreatment process, the aforementioned carbon fiber bundle, coated with the sizing agent whose structural formula includes ether linkages, is passed through an inert atmosphere at a temperature in the range of from 350° to 800° C. Thereupon, the sizing agent is thermally decomposed, and is scattered for the most part. At the temperature within the aforesaid range, however, there is a residue of decomposition which contains some or all of the ether linkages. If the ether linkages exist, fully reduced active titanium and boron are reacted with oxygen in the ether linkages, thereby forming a primary layer on the surface of each individual carbon filament (single filament) which constitutes the carbon fiber bundle, and active titanium and boron deposit to form a surface layer on the primary layer, in a CVD process mentioned later. Namely, the primary layer is formed of oxides consisting essentially of titanium and boron reacted with oxygen, while the surface layer is formed of active titanium and boron. Thus, the strength of bonding to the carbon fibers is increased, and wettability with molten metal is improved.

Preferably, the quantity of the residual ether linkages on the surface of each carbon filament is such that the atmic ratio of oxygen to carbon, ranges from 0.1 to 0.5 when the carbon filaments are analyzed by the ESCA (electron spectroscopy for chemical analysis). If this ratio is less than 0.1, sufficient titanium and boron for the improvement of wettability may fail to deposite on the carbon filament, or titanium boride may be formed, in some cases. If the count ratio exceeds 0.5, much of the deposited titanium and boron may change into titanium oxide and boron oxide, so that the wettability with the molten metal sometimes cannot be fully improved.

According to the ESCA, characteristic X-rays are applied to the surface of a sample, and the kinetic energy of electrons driven out by the photoelectric effect is measured to obtain the bond energy of the electrons. A substance has an atomic orbit peculiar to its constituent atoms. The spectrum of the ESCA represents a pattern of this orbit, and the oxidation number or the bonding state can be detected from the chemical shift of the characteristic position of the orbit. In the present invention, the above analysis is made using, for example, an X-ray photoelectric spectrophotometer, ESCA750, from Shimadzu Corporation, under conditions including MgKα rays (1,253.6 eV) for use as excit action X-rays, X-ray source voltage of 7 kV, X-ray source current of 30 A, temperature of 20° C., and degree of vacuum of $1.0\times10^{-5}$ Pa.

The pretreatment is performed in an inert atmosphere, such as argon, helium, or nitrogen. If it is effected in an active atmosphere, such as the air, the carbon fibers will be oxidized, so that their strength will lower, or in extreme cases, vanish.

As mentioned before, moreover, the treatment temperature should range from 350° to 800° C., preferably from 400° to 700° C. More specifically, at a temperature lower than 350° C., most of the sizing agent remains, and it is difficult for a gas to penetrate the carbon fiber bundle in the CVD process in a later stage, so that a satisfactory primary layer cannot be formed. If the temperature exceeds 800° C., on the other hand, all the ether linkages disappear, so that the primary layer cannot be formed, and the surface layer of titanium and boron, which is conducive to the improvement of wettability, cannot be satisfactorily formed. After all, the carbon fiber bundle cannot be uniformly impregnated with the molten metal.

Chemical Vapor Deposition (CVD) Process

In this CVD process, a material gas containing a titanium compound and a boron compound and a reducing gas containing zinc are caused simultaneously to act on the carbon fiber bundle at a temperature between 700° and 800° C., after the execution of the pretreatment process. Thereupon, the primary layer consisting of oxides of titanium and boron is formed on each individual carbon filament (single filament) which constitutes the continuous carbon fiber bundle, and the surface layer of titanium and boron, which is conducive to the improvement of wettability, is formed on the primary layer. There is not, however, any distinct interface between the primary layer and the surface layer. The fact is only that oxides of titanium and boron are predominant in the primary layer, while titanium and boron are so in the surface layer.

The titanium compound used should be titanium tetrachloride ($TiCl_4$) or titanium tetrabromide ($TiBr_4$), preferably titanium tetrachloride, and the boron compound used should be boron trichloride ($BCl_3$) or boron tribromide ($BBr_3$), preferably boron trichloride.

The temperature used should range from 700° to 800° C., preferably from 720° to 780° C. If the temperature is lower than 700° C., satisfactory reduction reaction does not take place, so that the coating layer cannot be formed. If the temperature exceeds 800° C., on the other hand, the coating layer comes to contain titanium carbide or titanium boride, and cannot enjoy good wettability with the molten metal.

If titanium tetrachloride and boron trichloride are used as the titanium compound and the boron compound, respectively, in this CVD process, the following reactions are expected to take place.

$$TiCl_4+Zn\rightarrow TiCl_2+ZnCl_2, \quad (1)$$

$$2BCl_3+3Zn\rightarrow 2B+3ZnCl_2, \quad (2)$$

$$3TiCl_2+2B\rightarrow 3Ti+2BCl_3. \quad (3)$$

The reaction of formula (3) may be replaced by $$2TiCl_2+2B\rightarrow Ti+2B+TiCl_4. \quad (4)$$

The CVD process can be executed by various methods. In the most desirable method, the material gas containing the titanium and the boron compound is introduced into a reaction chamber along the running direction of the carbon fiber bundle, and the zinc contained reducing gas carried by argon gas is introduced, into the reaction chamber from two to eight positions, in directions at right angles to the running direction of the fiber bundle. These two gases are mixed in close vicinity to the carbon fiber bundle, so that the material gas is reduced, whereby the composition formed on the surface layer is further stabilized. According to this method, the mixture of the material gas and the reducing gas reaches the carbon fiber bundle immediately after the two gases are mixed in the vicinity of the fiber bundle to permit satisfactory reduction. Thus, fully reduced active titanium and boron come to exist on the surface of the carbon filaments, and they reacts well with oxygen in the ether linkages on the carbon filament surface, thereby forming the primary layer. Since the material gas flows in the same direction as the running direction of the carbon fiber bundle, moreover, the reduction advances to a higher degree on the lower-course side, and the surface layer is richer with active titanium and boron on the outer side.

Composite Process

In this process, the carbon fiber bundle having undergone the CVD process is introduced, isolated from the open air, into the molten metal to form the matrix, to be impregnated with the molten metal, and is drawn up, whereupon the molten metal is solidified.

The carbon fiber bundle is isolated from the open air as it is introduced into the molten metal, in order to prevent titanium and boron in the surface layer from being oxidized. More specifically, it is necessary only that the course of the carbon fiber bundle be kept in an inert atmosphere, such as nitrogen or argon, at a temperature of about 500° C. or lower.

The metal used to form the matrix may be a simple metal, such as aluminum, magnesium, tin, or zinc, or an alloy consisting essentially of at least one of these metals. If the metal for the matrix is an aluminum alloy and if the surface of the carbon fibers is subjected to surface oxidation, a brittle phase such as an eutectic structure may be produced in the vicinity of the interface of carbon fibers and aluminium alloys, depending on the type of the aluminum alloy, so that the strength of the precursor wire may possibly be detriorated. In such a case, an aluminum alloy which contains 0.45% or less of silicon and 0.1% or less of copper, by weight, may be selected and used.

Preferably, the residence time of the carbon fiber bundle in the molten metal is about 30 seconds or less. Since the total thickness of the primary coat and the surface layer is as thin as about 50 to 500 Å, titanium and boron will liquate out or diffuse into the molten metal if the carbon fiber bundle is detained too long in the molten metal.

EXAMPLES AND COMPARATIVE EXAMPLES

Examples according to the present invention will now be described in comparison with comparative examples. The examples mentioned later were manufactured by means of a precursor wire manufacturing apparatus shown in FIG. 1. An outline of this apparatus will first be described.

The precursor wire manufacturing apparatus shown in FIG. 1 comprises a pretreatment furnace 10, a CVD device 20, a dipping device 30, a carbon fiber supply reel 5, and a take-up reel 35. The pretreatment furnace 10 is used to thermally decompose the sizing agent adhered to a carbon fiber bundle 40A. In the CVD device 20, the primary layer of oxides of titanium and boron is formed on each filament of a carbon fiber bundle 40B having undergone the pretreatment process, and the surface layer of titanium and boron is formed on the primary layer. The dipping device 30 is used to impregnate a carbon fiber bundle 40C, having undergone the CVD process, with the molten metal, and to solidify the molten metal. The supply reel 5, which is wound with the carbon fiber bundle 40A with the sizing agent adhered thereto, serves to deliver the fiber bundle 40A into the pretreatment furnace 10. The take-up reel 35 takes up a finished product (precursor wire) 40D.

The reel 5 delivers the carbon fiber bundle 40A into the pretreatment furnace 10 at a constant speed. The pretreatment furnace 10 has an annular chamber 12, and the carbon fiber bundle 40A is fed from one end of the chamber 12 to the other, along the central axis thereof. The temperature inside the chamber 12 can be adjusted by means of a heater 14, so that the inside of the chamber can be kept uniformly at a set temperature ranging from 350° to 800° C. The annular chamber 12 is long enough to allow the carbon fiber bundle 40A to stay in the oven for about 20 to 240 seconds. The inert gas, such as nitrogen or argon gas, is supplied through a port **12*a* near the other end of the chamber 12 on the lower-course side. On the upper-course side, the inert gas containing the sizing agent, which is thermally decomposed, and separated and scattered from the carbon fiber bundle, is discharged through a port 12*b* near the one end of the chamber 12**.

When the carbon fiber bundle 40A supplied from the reel 5 to the pretreatment furnace 10 is heated in the annular chamber 12, the sizing agent, which is adhered to the fiber bundle 40A and whose chemical structure includes the ether linkages, is thermally decomposed. Most of the decomposed sizing agent is scattered from the carbon fiber bundle 40A, only leaving the ether linkages. After undergoing the pretreatment process, the carbon fiber bundle 40B is delivered to the CVD device 20.

The CVD device 20 includes a reaction chamber 22 and a zinc melting chamber 26 housed therein. The internal temperature of the reaction chamber 22, which can be adjusted by means of a heater 24, is kept uniformly at a set temperature ranging from 700° to 800° C. The length of the reaction chamber 22 with respect to the fiber bundle feeding direction is adjusted to a length which allows the carbon fiber bundle 40B to stay in the reaction tube for about 20 to 180 seconds.

The zinc melting chamber 26 contains a boat 27 therein, in which zinc is heated and melted. The chamber 26 is provided with a plurality of nozzles **27*a*, e.g., four in number, which are formed in its outer wall facing the carbon fiber bundle 40B, so as to be arranged in the feeding direction for the fiber bundle 40B and extend at right angles to the feeding direction. Zinc vapor from the molten metal in the boat 27 is carried by argon gas supplied from an inlet pipe 27*b*, extending to the outside of the reaction chamber 22, and is ejected from the nozzles 27*a* toward the carbon fiber bundle 40B**.

A port **22*a* is attached to the upper-course-side end face of the reaction chamber 22, and the material gas containing the titanium compound and the boron compound, along with the argon gas as the carrier gas, is fed into the reaction chamber 22 through the port 22*a*. A port 22*b* is attached to the lower-course-side end face of the reaction chamber 22, and the reacted gas is discharged through the port 22*b***.

The reaction chamber 22 of the CVD device 20 and the dipping device 30 in the subsequent stage are connected by means of a duct 28. After undergoing the CVD process, the carbon fiber bundle 40C is guided through the duct 28 into the dipping device 30. The duct 28 is filled with argon gas of about 500° C. or lower, which serves to isolate the fiber bundle 40C from the open air.

The dipping device 30 is stored with a molten metal 32 used to form a matrix. The carbon fiber bundle 40C is introduced into the molten metal to be impregnated therewith, and is drawn up, whereupon the molten metal is solidified. The carbon fiber bundle 40C is allowed to stay in the molten metal for about 5 to 30 seconds. A shaping die 34 is provided at the outlet of the dipping device 30, and the carbon fiber bundle 40D shaped by means of the die 34 is wound up by the take-up reel 35.

EXAMPLE 1

A polyacrylonitrile polymer copolymerized with acrylic acid was wet-spun using dimethyl sulfoxide and water as a solvent and a coagulant, respectively, whereupon a continuous fiber bundle including 3,000 single acrylonitrile filaments was obtained.

Then, this continuous fiber bundle was subjected to 2 hours of heating for oxidazing in an oxidative atmosphere at 240° C., and was further heat-treated at a sintering temperature in the range of from 1,600° to 2,500° C. in a nitrogen atmosphere, whereupon a continuous carbon fiber bundle was obtained. Thereafter, energy was given to the continuous fiber bundle at the rate of 10 to 100 coulombs per 1 g of carbon fibers for surface oxidation by means of a current supply roller, using the fiber bundle as an anode. In this manner, five types of carbon fiber bundles, No. 1 to 5 shown in Table 1, with different $I_A$-$\frac{2}{3}$ widths were obtained.

Subsequently, the sizing agent was adhered to the carbon fiber bundles No. 1 to 5 by the following method.

First, (a) 30 parts by weight of "Epikote" 828 (Yuka Shell Epoxy Co., Ltd.), (b) 20 parts by weight of a condensate (acid value: 55) of 2 mol of additives including 1 mol of bisphenol A and 2 mol of ethylene oxide, 1.5 mol of maleic acid, and 0.5 mol of sebacic acid, (c) 5 parts by weight of polyoxyethylenestyrenated cumylphenol (70 mol of polyoxyethylene and 5 mol of styrene), and (d) 45 parts by weight of water were prepared. The materials (a), (b) and (c) were charged into a high-viscosity emulsifier, and were heated to 50° to 60° C. and homogenized. Ten percent by weight of the material (d) was added to the mixture, and the resulting material was fully stirred at 40° C. or below to be emulsified. After this phase inversion, the remainder of the material (d) was gradually added, whereupon a homogeneous emulsion with a uniform concentration of 55% and viscosity of 200 cps was obtained. Further, this emulsion was diluted with water to obtain an emulsion solution of 3.5% solid content, which served as a sizing agent treatment solution.

After the carbon fiber bundles were passed through the above-mentioned solution, they were further passed through a heated zone of 150° to 160° C. for several minutes to be dried. Virtually, 1.2% by weight of the sizing agent adhered to the resulting carbon fiber bundles.

Then, the individual carbon fiber bundles No. 1 to 5, with the sizing agent adhered thereto, were passed through the heating furnace 10 (FIG. 1) kept in a nitrogen atmosphere at 700° C., for 3 minutes, whereby the sizing agent on the carbon fiber bundles was thermally decomposed (pretreatment process).

After undergoing the pretreatment process, the carbon fiber bundles were passed through the reaction chamber 20 so that they stayed therein for 2 minutes. Thus, a primary layer of oxides consisting of titanium and boron and a surface layer consisting of titanium and boron were formed on each individual carbon filament constituting the carbon fiber bundles (CVD process). At this time, the reaction chamber 20 was kept at 750° C., a gas containing 6% of titanium tetrachloride, 1.7% of boron trichloride, and 92.3% of argon, all by weight, was run in the running direction of the carbon fiber bundles, and a gas containing 14% of zinc and 86% of argon, by weight, was run from four positions, in directions at right angles to the running direction of the fiber bundles.

After undergoing the CVD process, the carbon fiber bundles were introduced into the molten metal of aluminum alloy (JIS A-1100 equivalent to ASTM AA-1100) of 680° C. in the dipping device 30. In doing this, the fiber bundles were isolated from the open air by means of an argon atmosphere, and were run so as to stay in the molten metal for 15 seconds. Then, the fiber bundles were drawn up, and the aluminum alloy was solidified (composite process). Thus, five types of precursor wires were obtained having a carbon fiber volume content Vf of about 50%.

Subsequently, tension tests were conducted on those five types of precursor wires using a drawing speed of 2 mm/min, by means of an autograph, AG-500B, manufactured by Shimadzu Corporation. Table 1 shows the results of the tests.

TABLE 1

| | Carbon Fibers | | Precursor Wires | |
|---|---|---|---|---|
| | No. | $\frac{2}{3}$ Width ($cm^{-1}$) | Translation of Strength (%) | Yield (%) |
| Control | 1 | 23 | 30 to 85 | 25 |
| Products of Invention | 2 | 25 | 91 to 97 | 95 |
| | 3 | 52 | 87 to 97 | 95 |
| | 4 | 75 | 90 to 95 | 96 |
| Control | 5 | 78 | 40 to 45 | 98 |

Table 1 indicates that only those precursor wires which use carbon fibers having the $\frac{2}{3}$ width ranging from 25 to 75 $cm^{-1}$ are not very variable in strength and have a relatively high tensile strength. The yield is defined as follows:

yield = {(length of precursor wire obtaned)/length of carbon fiber bundle)} × 100

The translation of strength is given by translation of strength = [(tensile strength of precursor wire)/{(tensile strength of carbon fiber bundle) × $V_f$}] × 100.

EXAMPLE 2

Polyacrylonitrile-based carbon fiber bundles, M40J-6000-50B (each including 6,000 single filaments, nonstranded yarn; $I_A$-$\frac{2}{3}$ width: 42 $cm^{-1}$) from Toray Industries, Inc., manufactured in the same manner as Example 1, were treated according to the same processes of Example 1, and were impregnated with aluminum alloys shown in Table 2. Thereupon, precursor wires were formed having the volume content $V_f$ of about 50%. The same tension tests for Example 1 were conducted on the individual precursor wires thus obtained. Table 2 shows the results of these tests.

TABLE 2

| | | Content (wt %) | | Precursor Wires | |
|---|---|---|---|---|---|
| | Alloys | Copper | Silicon | Translation of Strength (%) | Yield (%) |
| Products of Invention | Alloy 1 | 0.08 | 0.41 | 92 to 98 | 96 |
| Controls | Alloy 2 | 0.20 | 0.32 | 50 to 55 | 93 |
| | Alloy 3 | 0.08 | 0.61 | 51 to 54 | 94 |
| | Alloy | 0.21 | 0.69 | 47 to 52 | 95 |

TABLE 2-continued

| Alloys | Content (wt %) Copper | Content (wt %) Silicon | Precursor Wires Translation of Strength (%) | Precursor Wires Yield (%) |
|---|---|---|---|---|
| 4 | | | | |

As seen from Table 2, although any of the precursor wires can be manufactured with high yield, only those precursor wires which use aluminum alloy containing 0.1% or less of copper and 0.45% or less of silicon, by weight, can enjoy a high translation of strength.

EXAMPLE 3

A polyacrylonitrile-based carbon fiber bundle, M40J-6000-50B (including 6,000 single filaments) from Toray Industries, Inc., to which was adhered a sizing agent containing epoxy resin whose chemical structure includes ether linkages, was treated according to the same processes of Example 1, whereupon a precursor wire was obtained using aluminum alloy (JIS A-1100) as its matrix. In this example, the quantity of ether linkages left on the surface of each carbon filament after the pretreatment process was 0.28, as expressed by the atomic ratio of oxygen to carbon, based on the ESCA analysis.

Figure 2:
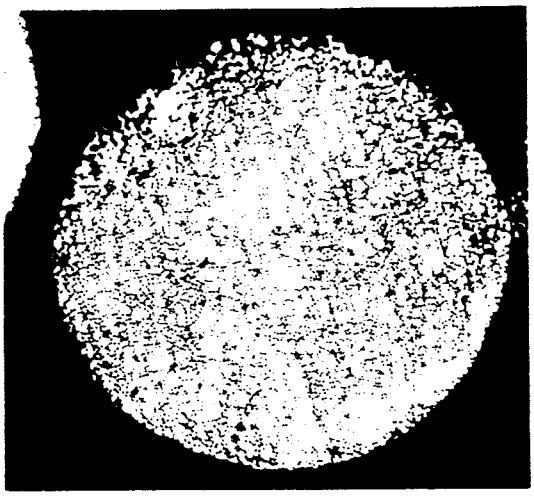
FIG. 2 is a microphotograph showing the state of impregnation of a matrix, as viewed along a cross section of a precursor wire manufactured by the method of the invention.

The precursor wire thus obtained was embedded in resin and rapped. The cross section of the precursor wire was observed by means of a optical microscope. Thereupon, as shown in FIG. 2 (magnification: 100 diameters), the carbon fiber bundle was found to be impregnated fully and uniformly with the aluminum alloy.

Argon ions were applied to the precursor wire of Example 3 for 20 hours of etching by means of an ion milling system, Model 600, from Gatan Co., Ltd., and a sample leaf was obtained from this precursor wire. This leaf was analyzed by means of an energy-dispersive X-ray spectrometer, Super 8000, from Kevex Co. Ltd., under conditions including an accelerating voltage of 100 kV, sample absorbing current of $10^{-9}$ A, and measuring time of 50 seconds. In doing this, the cross section of the precursor wire was observed to identify the position of analysis by means of a scanning transmission electron microscope, HB501, from VG Microscope Co., Ltd., using the accelerating voltage of 100 kV. Table 3 shows the weight percents of oxygen and titanium obtained with respective several points of analysis shown in FIGS. 3 and 4.

Figure 3:
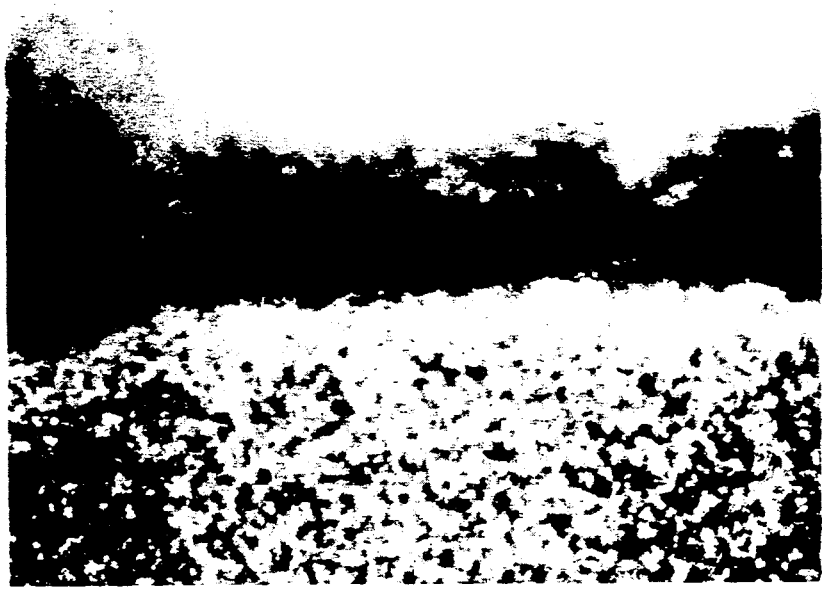
FIG. 3 is a microphotograph of a cross section of a precursor wire manufactured by the method of the invention, taken through a scanning transmission electron microscope.
Figure 4:
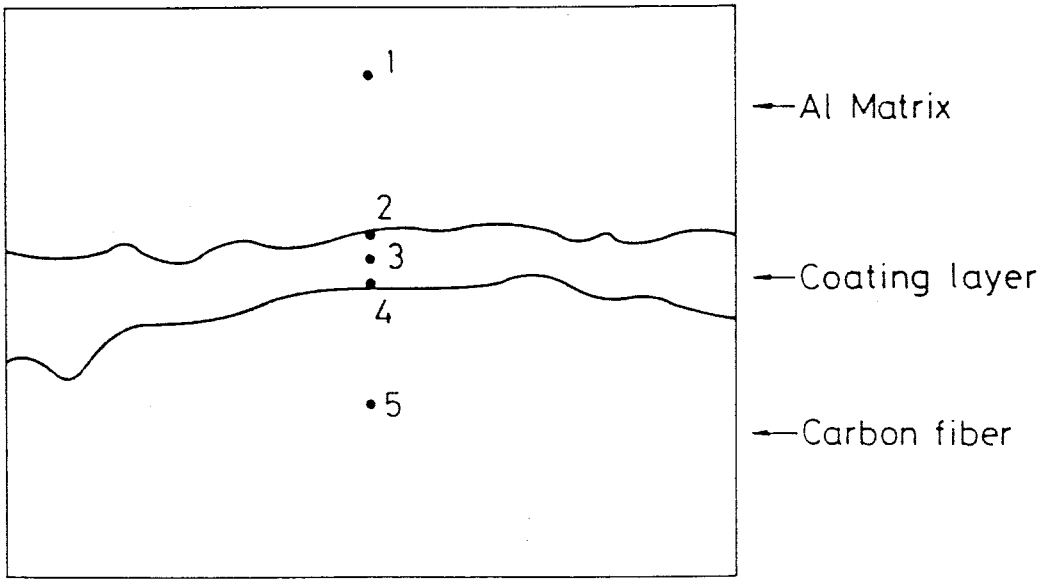
FIG. 4 is a sketch of the microphotograph of FIG. 3, showing the detection points from which weight ratios of oxygen and titanium to the total weght are determined using an energy-dispersive X-ray spectrometer.

Supposedly, as seen from FIGS. 3 and 4, a coating layer formed between a carbon filament and an aluminum matrix contains more oxygen, and therefore, more oxide of titanium, at regions nearer to the surface of the carbon filament. On the other hand, titanium increases with distance from the filament surface, that is, the titanium content in the coating layer decreases with increasing the distance from the aluminum matrix. Presumably, therefore, active titanium are rich in the region of the coating layer near the matrix.

Boron, which is a light element, cannot be detected by means of the energy-dispersive X-ray spectrometer. On the analogy of the measurement results on titanium shown in Table 3, however, boron can be supposed be distributed with the same weight ratios as titanium.

In consideration of these circumstances, it can be concluded that the coating layer is formed of a primary layer containing substantial amounts of oxides of titanium and boron and a surface layer containing substantial amounts of titanium and boron.

TABLE 3

| Posision | Titanium (wt %) | Oxygen (wt %) |
|---|---|---|
| 1 | 0.00 | 0.00 |
| 2 | 16.05 | 4.41 |
| 3 | 12.64 | 22.03 |
| 4 | 4.78 | 32.29 |
| 5 | 0.00 | 0.00 |

EXAMPLE 4

A precursor wire was obtained in the same manner as in Example 3 except that a temperature of 350° C. was used in the pretreatment process. In this example, the quantity of ether linkages left on the surface of each carbon filament after the pretreatment process was 0.50, as expressed by the atomic ratio of oxygen to carbon, based on the ESCA analysis.

The cross section of the precursor wire thus obtained was observed in the same manner as in Example 3. Thereupon, the carbon fiber bundle, like the one shown in FIG. 2, was found to be impregnated fully and uniformly with the aluminum alloy.

EXAMPLE 5

A precursor wire was obtained in the same manner as in Example 3 except that a temperature of 600° C. was used in the pretreatment process. In this example, the quantity of ether linkages left on the surface of each carbon filament after the pretreatment process was 0.42, as expressed by the atomic ratio of oxygen to carbon, based on the ESCA analysis.

The cross section of the precursor wire thus obtained was observed in the same manner as in Example 3. Thereupon, the carbon fiber bundle, like the one shown in FIG. 2, was found to be impregnated fully and uniformly with the aluminum alloy.

EXAMPLE 6

A precursor wire was obtained in the same manner as in Example 3 except that a temperature of 800° C. was used in the pretreatment process. In this example, the quantity of ether linkages left on the surface of each carbon filament after the pretreatment process was 0.11, as expressed by the atomic ratio of oxygen to carbon, based on the ESCA analysis.

The cross section of the precursor wire thus obtained was observed in the same manner as in Example 3. Thereupon, the carbon fiber bundle, like the one shown in FIG. 2, was found to be impregnated fully and uniformly with the aluminum alloy.

COMPARATIVE EXAMPLE 1

The same M40J-6000-50B used in Example 3 was used as a carbon fiber bundle. In this example, however, the fiber bundle had no sizing agent thereon. A precursor wire was obtained in the same manner as in Example 3.

The cross section of the precursor wire thus obtained was observed in the same manner as in Example 3. Thereupon, the inner part of the carbon fiber bundle was found to be hardly impregnated with the aluminum alloy, although the outside was impregnated. Apparently, however, the precursor wire of this example resembled the one described in connection with Example 3.

COMPARATIVE EXAMPLE 2

A precursor wire was obtained in the same manner as in Example 3 except that a temperature of 850° C. was used in the pretreatment process. In this comparative example, the quantity of ether linkages left on the surface of each carbon filament after the pretreatment process was 0.07, as expressed by the atomic ratio of oxygen to carbon, based on the ESCA analysis.

Figure 5:
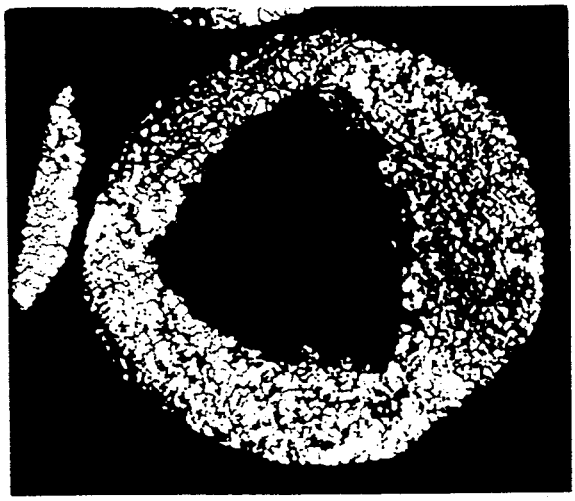
FIG. 5 is a microphotograph showing the state of impregnation of a matrix, as viewed along a cross section of a precursor wire manufactured by a method used as a control for comparison.

The cross section of the precursor wire thus obtained was observed in the same manner as in Example 3. Also in this case, the inner part of the carbon fiber bundle was found to be hardly impregnated with the aluminum alloy, but not to such a degree as shown in FIG. 5.

COMPARATIVE EXAMPLE 3

A precursor wire was obtained in the same manner as in Example 3 except that a temperature of 650° C. was used in the chemical vapor deposition process.

The cross section of the precursor wire thus obtained was observed in the same manner as in Example 3. Also in this case, the inner part of the carbon fiber bundle was found to be hardly impregnated with the aluminum alloy, but not to such a degree as shown in FIG. 5.

COMPARATIVE EXAMPLE 4

A precursor wire was obtained in the same manner as in Example 3 except that a temperature of 850° C. was used in the chemical vapor deposition process.

The cross section of the precursor wire thus obtained was observed in the same manner as in Example 3. Thereupon, the inner part of the carbon fiber bundle was not substantially found to be impregnated with any aluminum alloy.

EXAMPLE 7

The same M40J-6000-50B used in Example 3 was used as a carbon fiber bundle, and was treated in the same manner as in Example 3. Several fiber bundles thus treated were dipped individually into molten magnesium, zinc, tin, silver, and copper to produce precursor wires by way of trial. Among these metals, only magnesium, zinc, and tin, which have relatively low melting points, were able to be impregnated into the carbon fiber bundles to provide the precursor wires. The respective cross sections of the precursor wires thus obtained were observed in the same manner as in Example 3. Thereupon, the carbon fiber bundles, like the one shown in FIG. 2, were found to be impregnated fully and uniformly with the matrix metal.

COMPARATIVE EXAMPLE 5

The same M40J-6000-50B used in Example 3 was used as a carbon fiber bundle. After undergoing the same pretreatment process and CVD process as in Example 3, the carbon fiber bundle was exposed to the open air, and was then dipped into molten aluminum. When the carbon fiber bundle, having undergone the CVD process, once touched the open air, it was not able to be wetted by the molten aluminum, so that no precursor wire was able to be obtained.

Thereupon, the carbon fiber bundle exposed to the open air after the CVD process was subjected to the ESCA analysis in the same manner as in Example 3. Table 4 shows the results of analysis of peak division.

TABLE 4

| $C_{1S}$ Peak | | $Ti_{2P}$ Peak | | $B_{1S}$ Peak | |
|---|---|---|---|---|---|
| C (%) | MC (%) | $TiO_2$ (%) | Ti,$TiB_2$,TiC (%) | $B_2O_3$ (%) | B,$TiB_2$ (%) |
| 100 | 0 | 100 | 0 | 91 | 9 |

From Table 4, it is clear that no peaks attributed to metallic carbide (MC) and titanium carbide or titanium boride were detected from the carbon ($C_{1S}$) peak and titanium ($Ti_{2P}$) peak. It is evident, therefore, that neither titanium carbide nor titanium boride existed on the surface of each carbon filament. A peak attributed to metallic boron or titanium boride, as well as a peak attributed to boron oxide, was barely detected from the boron ($B_{1S}$) peak. On the analogy of the conclusion on the titanium ($Ti_{2P}$) peak, the detected peak can be considered to be attributed to metallic boron. Thus, in consideration of the analytic results of the ESCA and the fact that the CVD-treated carbon fibers cannot be wetted by the molten metal when exposed to the open air, it is to be understood that the surface of the carbon filament treated by the method of the present invention is coated with a coating mixture of titanium and boron and partial oxides thereof.

What is claimed is:

1. A method for manufacturing a precursor wire for a carbon-fiber-reinforced metal composite material, comprising:

a pretreatment process for passing a continuous fiber bundle including a number of single carbon filaments with a sizing agent adhered thereto through an inactive atmosphere at a temperature in the range of from 350° to 800° C., thereby thermally decomposing said sizing agent, the chemical structure of said sizing agent including ether linkages, and leaving a residue of thermal decomposition containing said ether linkages on the surface of each said single filament;

a chemical vapor deposition process for causing a material gas containing a titanium compound and a boron compound and a reducing gas containing zinc to act simultaneously on the continuous fiber bundle at a temperature in the range of from 700° to 800° C. after said sizing agent is thermally decomposed, thereby forming a primary layer consisting of titanium oxides and boron oxides on each said single filament, and forming a surface layer consisting of titanium and boron on said primary layer; and a composite process for introducing said continuous fiber bundle, with said primary layer and said surface layer formed thereon, into a molten metal used to form a matrix, while isolating said continuous fiber bundle from the open air, thereby impregnating said continuous fiber bundle with said molten metal, and drawing up said continuous fiber bundle so that said molten metal is solidified.

2. The manufacturing method according to claim 1, wherein said metal used to form the matrix is selected from the group of metals consisting of aluminum, aluminum alloy, magnesium, magnesium alloy, tin, tin alloy, zinc, and zinc alloy.

3. The manufacturing method according to claim 1, wherein said carbon filaments have a $\frac{2}{3}$-width ranging from 25 to 75 $cm^{-1}$, as measured on the basis of Raman spectroscopy, said $\frac{2}{3}$-width corresponding to $\frac{2}{3}$ of the peak level of a Raman band obtained corresponding to a wave number of about 1,585 $cm^{-1}$, said peak level attributed to $E_{2g}$ symmetric vibration of a graphite structure;

4. The manufacturing method according to claim 3, wherein said metal used to form the matrix is aluminum or aluminum alloy.

5. The manufacturing method according to claim 4, wherein said metal used to form the matrix is aluminum alloy containing not more than 0.45% of silicon and not more than 0.1% of copper, both by weight based on the weight of the matrix.

6. The manufacturing method according to claim 1, wherein the chemical structure of said sizing agent includes ether linkages expressed by one of general formulas R-O-R', Ar-O-R, and Ar-O-Ar' (R, R'=alkyl group; Ar, Ar'=aryl group).

7. The manufacturing method according to claim 6, wherein said sizing agent comprised at least one material selected from the group having subgroups of:

epoxy resin sizing agent materials consisting of (1) bisphenol type resins obtained by the condensation of epichlorohydrin and one or more bisphenols, consisting of bisphenol A, bisphenol F, and 2,2'-bis(4-hydroxyphenyl)butane, (2) phenol type resins obtained by causing epichlorohydrin to act on novolac phenol resins, (3) ester type resins obtained by copolymerizing glycidyl methacrylate and monomers containing ethylenic linkage, and (4) ether type resins obtained by causing epichlorohydrin to act on one or two consisting of polyols and polyether polyols;

polyether type sizing agent materials consists of (1) hydroxyl-terminated polyethers obtained by the addition polymerization of one or more polyhydric alcohols consisting of ethylene glycol, propylene glycol, butylene glycol, glycerin, trimethylolpropane, and pentaerythritol, and one or more alkylene oxides consisting of ethylene oxide, propylene oxide, butylene oxide, and tetrahydrofuran, (2) alkylene oxide polymers polymerized by addition reaction of one or two polyhydric phenols consisting of resorcinol and bisphenol, and (3) alkylene oxide polymers polymerized by addition reaction of one or more polybasic carboxylic acids consisting of succinic acid, adipic acid, fumaric acid, maleic acid, glutaric acid, dimer acid, and pyromellitic acid; and polyester type sizing agent materials consisting of (1) condensates of one or more polyhydric alcohols consisting of ethylene glycol, butylene glycol, glycerin, trimethylolpropane, and pentaerythritol, and one or more polybasic carboxylic acids consisting of succinic acid, adipic acid, fumaric acid, maleic acid, glutaric acid, dimer acid, and pyromellitic acid, (2) condensates of hydroxy-carboxylic acid and polyhydric alcohols consisting of ethylene glycol, butylene glycol, glycerin, trimethylolpropane, and pentaerythritol.

8. The manufacturing method according to claim 1, wherein the quantity of the ether linkages left on the surface of the carbon filaments by the thermal decomposition of said sizing agent is detected by the electron spectroscopy for chemical analysis so that the atomic ratio of oxygen to carbon ranges from 0.1 to 0.5.

9. The manufacturing method according to claim 1, wherein said chemical vapor deposition process includes guiding said continuous fiber bundle into a reaction chamber to cause the continuous fiber bundle to run in the reaction chamber, running a material gas containing titanium tetrachloride and boron trichloride carried by argon gas, along the running direction of said continuous fiber bundle, and guiding the zinc contained reducing gas carried by argon gas toward the continuous fiber bundle in a direction at right angles to the running direction thereof.

* * * * *